US005524823A

United States Patent [19]

Miller

[11] Patent Number: 5,524,823

[45] Date of Patent: Jun. 11, 1996

[54] TAMPER PROOF DRINKING FOUNTAIN ATTACHMENT

[76] Inventor: Vicki L. Miller, 855 Horns Corners Rd., Cedarburg, Wis. 53012

[21] Appl. No.: 361,977

[22] Filed: Dec. 22, 1994

[51] Int. Cl.[6] ..... E03B 9/20

[52] U.S. Cl. ..... 239/29; 239/586

[58] Field of Search ..... 239/25, 28, 29, 239/583, 586

[56] References Cited

U.S. PATENT DOCUMENTS

| | | | |
|---|---|---|---|
| 3,237,863 | 3/1966 | Wollmershauser | 239/25 |
| 3,325,101 | 6/1967 | Cuschera | 239/25 |
| 3,335,957 | 8/1967 | Jacobson | 239/25 |
| 3,438,577 | 4/1969 | Mackie et al. . | |
| 3,925,829 | 12/1975 | Bost | 239/25 X |

*Primary Examiner*—Kevin P. Weldon
*Attorney, Agent, or Firm*—Foley & Lardner

[57] ABSTRACT

A tamper proof fountain attachment adapted to be mounted on a water faucet, the fountain attachment including a base member having a flow path aligned with the faucet and a passage transverse to the flow path, a spigot assembly mounted in the passage for movement between open and closed positions with respect to the flow path, a cover permanently mounted on the top of the base member for connecting the base member to the faucet, a cap permanently mounted on the bottom of the base member, the spigot assembly including a shaft having an offset bore on one end for directing water angularly upwardly from the spigot assembly and a spring for biasing the shaft to a closed position in the base member.

10 Claims, 6 Drawing Sheets

TAMPER PROOF DRINKING FOUNTAIN ATTACHMENT

FIELD OF THE INVENTION

The present invention relates to a drinking fountain assembly which can be mounted on a faucet and more particularly to a plastic molded and sealed device for providing a drinking fountain on a conventional faucet.

BACKGROUND OF THE INVENTION

A drinking fountain attachment is shown and described in U.S. Pat. No. 3,438,577, issued on Apr. 15, 1969, entitled "Drinking Fountain Attachment." The fountain attachment can be mounted on a standard water faucet thereby selectively providing a water fountain on the faucet. A cap having a raised member located in the central passage of the housing prevents rotation of the movable member. The attachment is mounted on the water faucet and includes a cylindrical member which is mounted in the housing for axial motion between open and closed position with respect to the housing. A head is mounted on one end of the cylindrical member which includes a water passage for directing a stream of water upwardly from the cylindrical member. The head is biased to a closed position by a spring mounted in a cap secured to the other end of the cylindrical member by a screw. The screw can be removed from the cylindrical member to reset the head at different angular positions or to remove the head from the faucet.

SUMMARY OF THE PRESENT INVENTION

The present invention relates to a drinking fountain which can be mounted on a water faucet and actuated to provide a jet of water from the fountain. One of the basic features of the fountain is the construction of a water tight device which when snapped together cannot be taken apart. This is of significant importance if the fountain is used by children.

One of the principal features of this invention is the ability to adjust the position of the fountain after the fountain has been mounted on the faucet.

A further feature of this invention is the restriction of the rotation of the spigot to 30 degrees on each side of center.

Other principal features and advantages of the invention will become apparent to those skilled in the art upon review of the following drawings, the detailed description and the appended claims.

Figure 1:
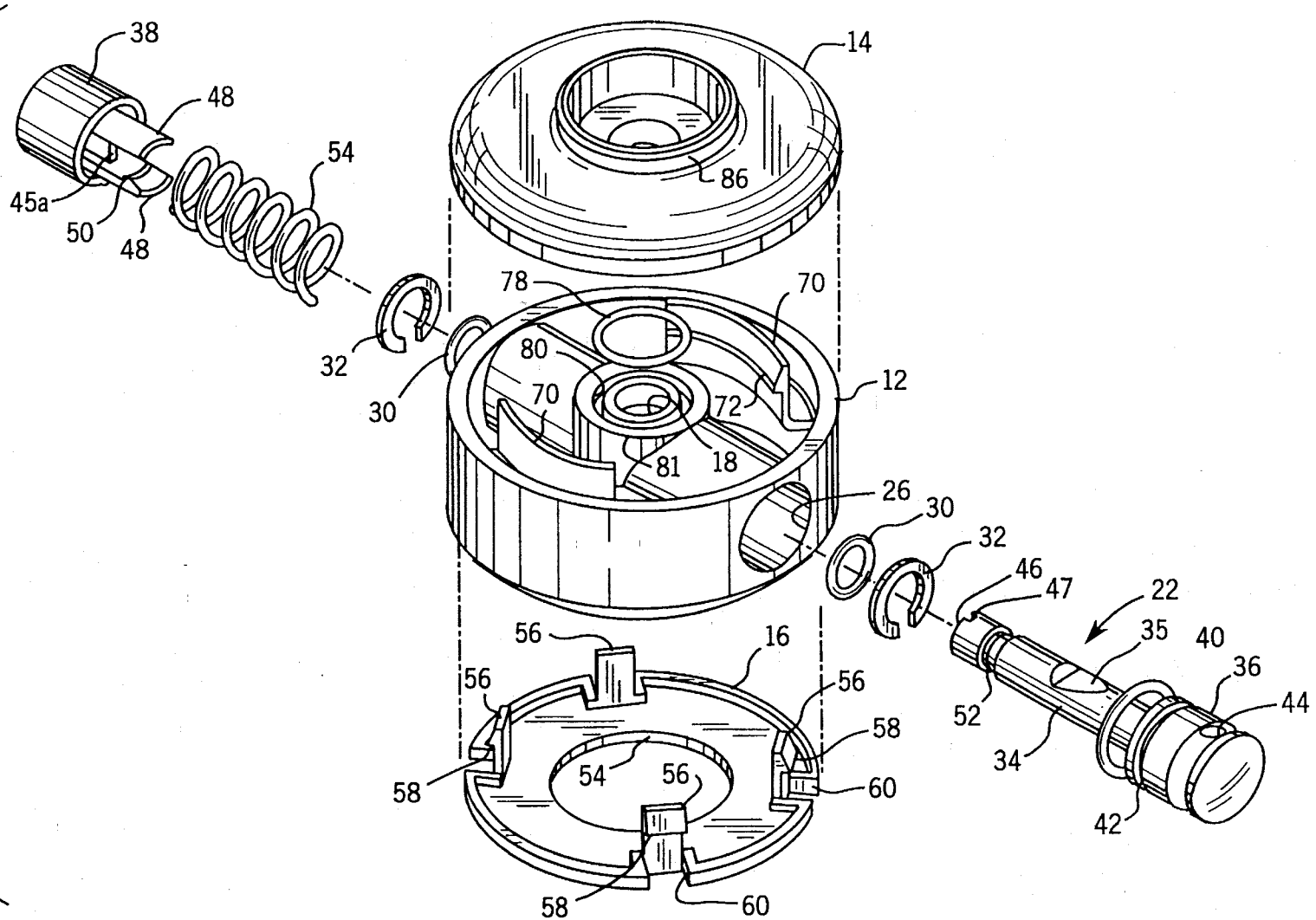
FIG. 1 is an exploded perspective view of the top side of the faucet according to the present invention.
Figure 2:
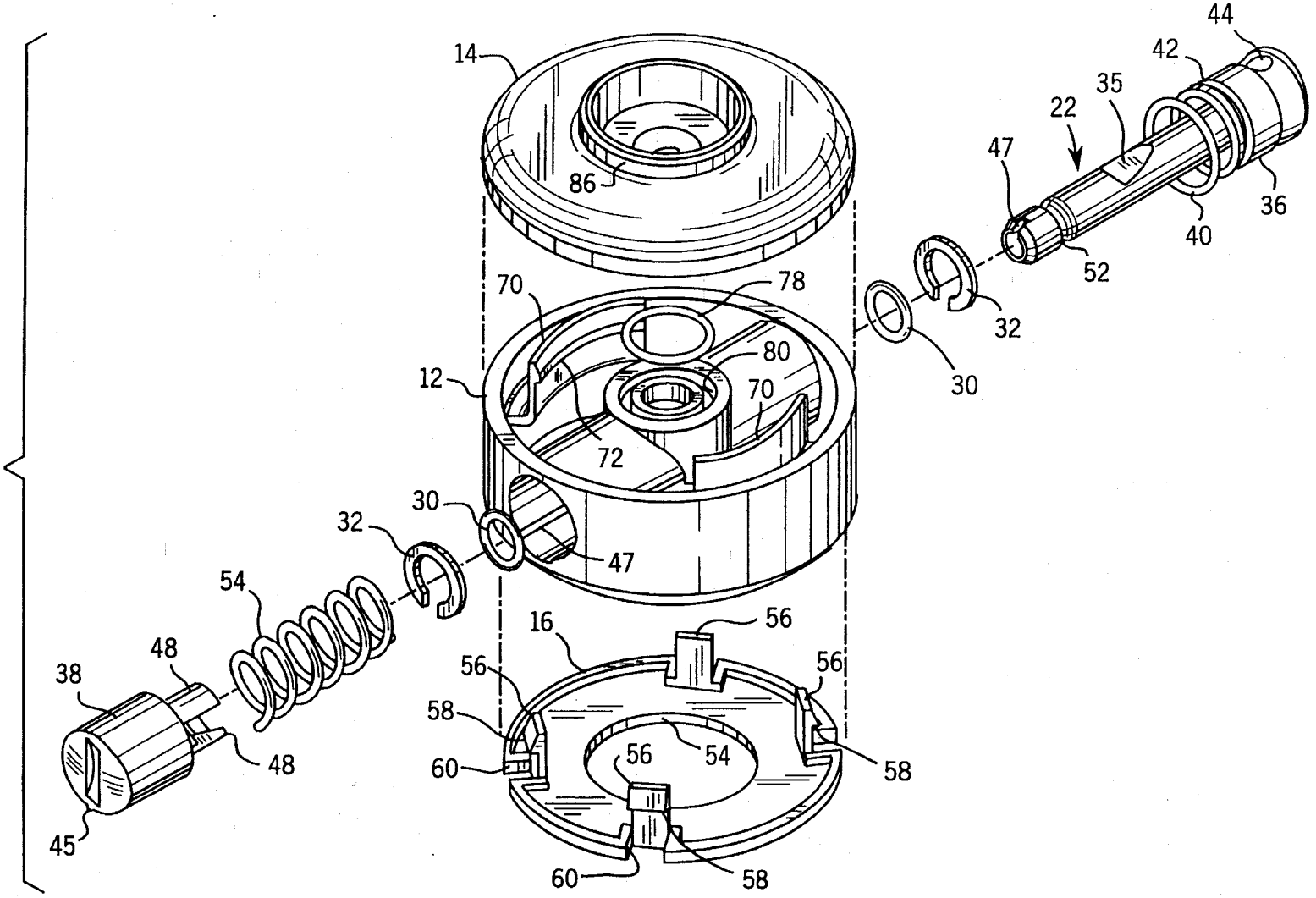
FIG. 2 is a view similar to FIG. 1 turned 90° to show the interconnection of the parts.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The tamper proof water fountain 10 according to the present invention generally includes a cylindrical base or housing 12, a cover plate 14 and a bottom or base plate 16. The base 12 includes a central opening 18 and a cross bore 20. A spigot assembly 22 is aligned in the cross bore 20 for axial movement between open and closed positions with respect to the base 12. The cross bore 20 includes a recess 26 on each side of the cross bore 20. A circular groove 28 is provided on the inner end of each of the recesses 26. An 0 ring seal 30 is positioned in grooves 28 and retained therein by snap rings 32. A pair of arcuate flanges 70 are provided on the top of housing 12. Each flange includes a notch 72.

The spigot assembly 22 as shown in the drawings generally includes a main shaft 34 having a cap 36 formed on one end. A cap 38 is mounted on the end of shaft 34. An O ring seal 40 is positioned in a groove 42 in the cap 36 to seal the cap in the recess 26. An angularly offset bore 44 is provided in the cap 36 to direct the flow of water from the spigot. The shaft 34 is aligned in the openings 20 in the cap 12. The inner end 46 of the shaft 34 is positioned to engage the end cap 38 which is mounted in the recess 26 at the opposite end of cross bore 20.

Figure 4:
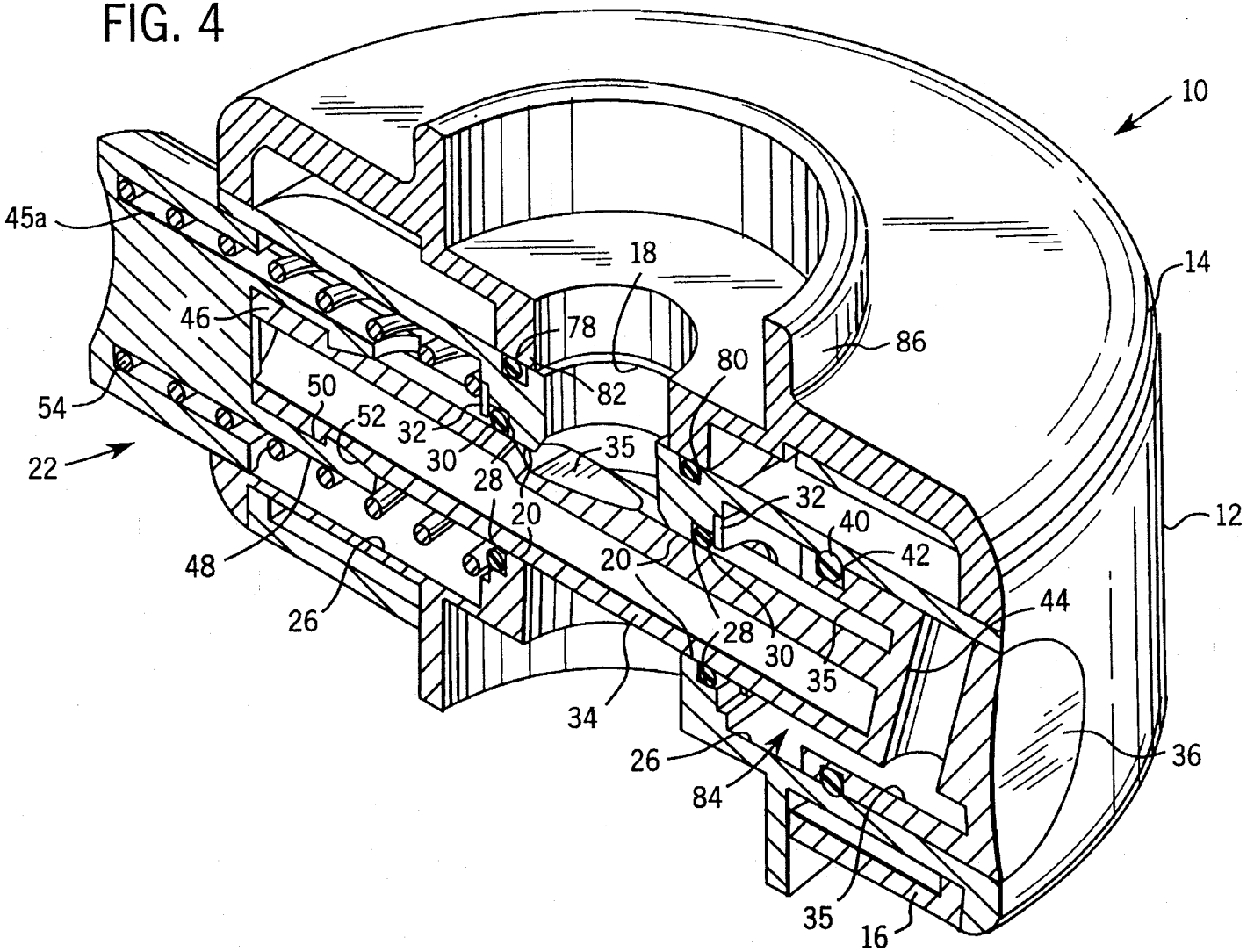
FIG. 4 is a perspective view partly broken away to show the relation of the parts of the fountain.

In this regard the end cap 38 includes a pair of flanges 48 located inwardly from the end of the cap 38. A notch 50 is provided on the end of each of the flanges 48 which engage a tapered groove 52 provided on the end of the shaft 34 when the shaft 34 is pushed into the flanges 48 as shown in FIG. 4. A slot **47*a* is provided in the end of shaft 34 which engages the end of a block 45*a* in cap 38 to prevent rotation of the spigot 36 with respect to the cap 38. A notch 35 is provided on the shaft 34 to provide communication with the bore 44 in the cap 36. A spring 54 is positioned in the recess 26 with one end seated on the end of recess 26 and the other end seated in a groove 45 in cap 38**.

Rotation of the spigot 34 is limited to 60° by means of a tab 45 provided in cap 38 which is aligned with a slot 47 in the recess 26. The spigot assembly can be rotated by inserting the edge of a coin or the like into the notch 37 in cap 38.

The base plate 16 is provided with a central opening 54 and four tabs 56 equally spaced around the perimeter of the plate 16. A flange 58 is provided on the outside of each of the tabs 56. A slot 60 is provided in the plate 16 at the base of each of the tabs 56. The base plate 16 is aligned with the opening 62 in the bottom of the housing 12 with the slots 60 aligned with blocks 64 located at equally spaced intervals around the inside perimeter of the housing 12. A circular opening 66 is provided in the base plate 12 which matingly engages the perimeter of a cylindrical member 68 provided in the base 12.

Figure 3:
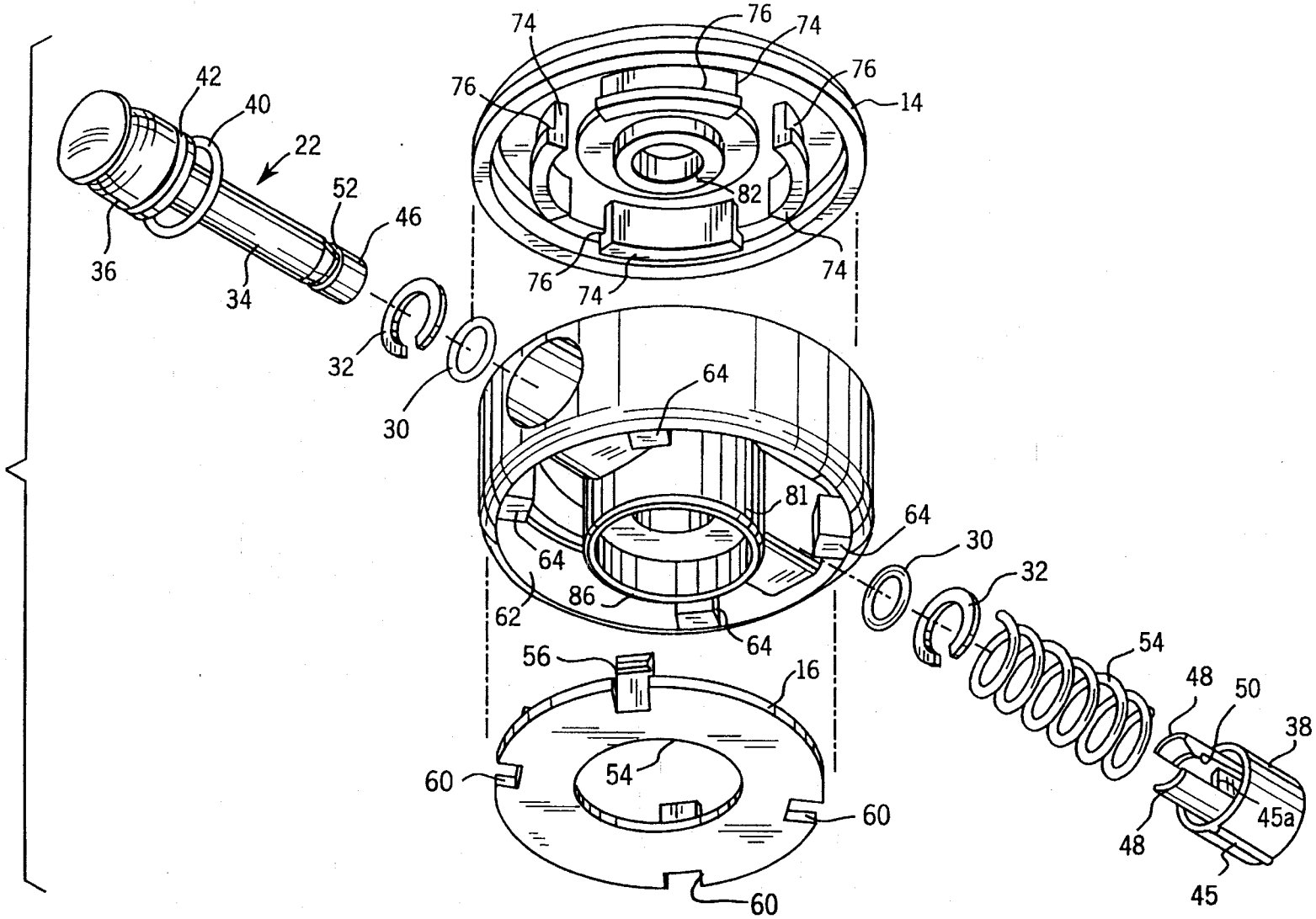
FIG. 3 is an exploded bottom view of the faucet showing the snap connection of the various parts.

The cover plate 14 as shown in FIGS. 1 and 3 includes four arcuate flanges 74 on the inside surface of the cover plate 14. A catch 76 is provided around the outer perimeter of each of the flanges 74. The cover 14 is aligned with the base 12 with the flanges 74 positioned to matingly engage the inside perimeter of the arcuate flanges 70. The catches 76 inter engage with the notches 72 to retain the cover on the base. It should be noted that the cover plate includes four flanges 74 and the housing 12 includes two wide flanges 70 so that the cover once mounted on the housing cannot be released from the flanges 70 by rotating the cover plate 14. The base 12 is therefore free to rotate on the cover after mounting on the faucet. The cover is sealed to the housing by means of an O ring seal 78 positioned in a groove 80 in the top of a circular member 81 in housing 12. A flange 82 on the bottom of the cover plate 14 retains the O-ring in the groove 80. A threaded section 86 is provided at the top of the cover plate 14 for connection to a faucet. A threaded section 88 is also provided on the bottom of cylindrical member 81 for supporting an aerator.

A notch 35 is provided in the shaft 34 to connect the opening 18 to the bore 44. In this regard a circumferential passage 84 is provided between the shaft 34 and the inside surface 35 of cap 36. When the cap 36 is pushed outward, the notch 35 in shaft 34 will pass through the opening 20 connecting the flow path of water through the opening 18 to passage 84 allowing the water to flow out of the cap 36 through bore 34.

Figure 5:
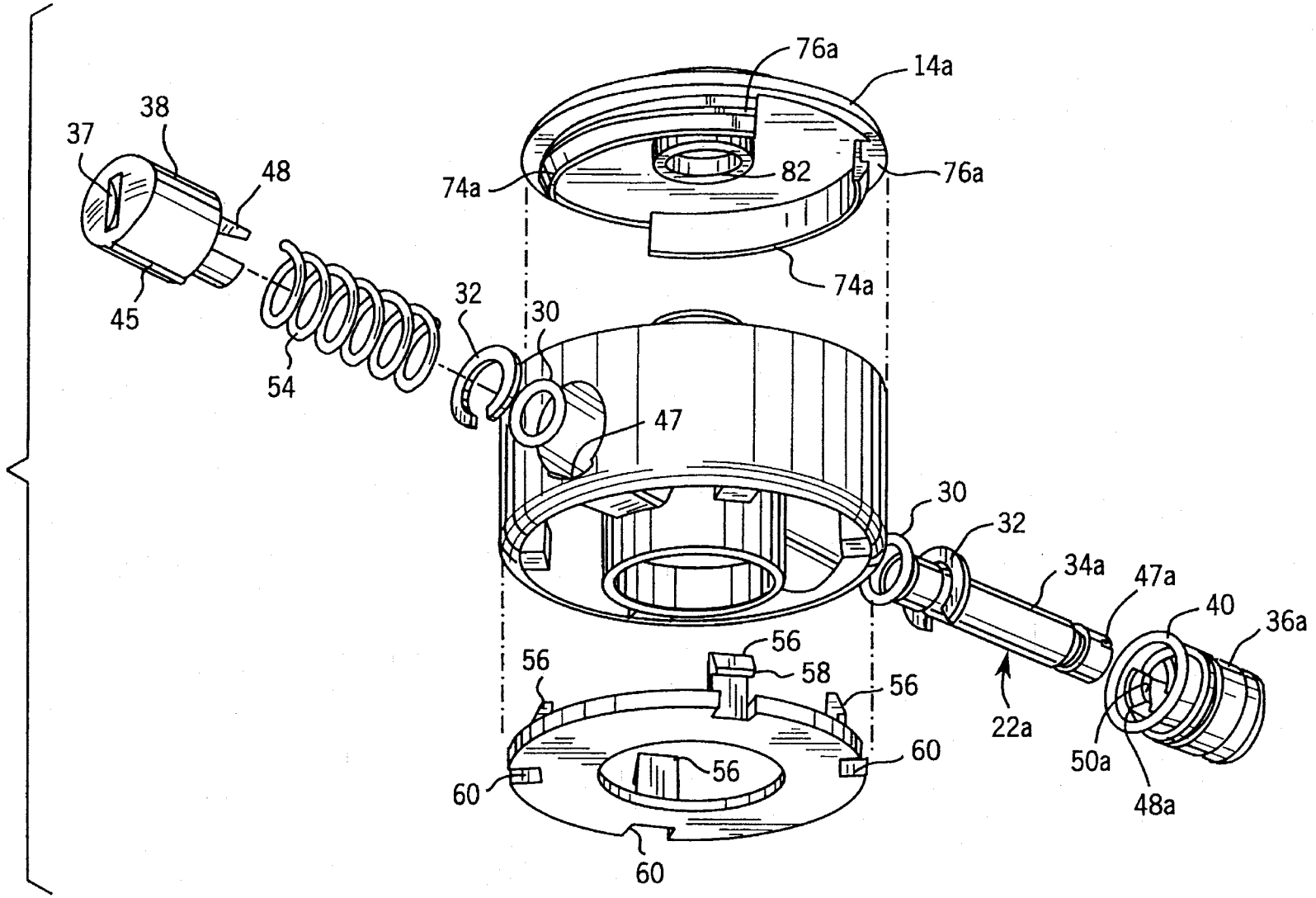
FIG. 5 is a perspective view of an alternate embodiment of the fountain.
Figure 6:
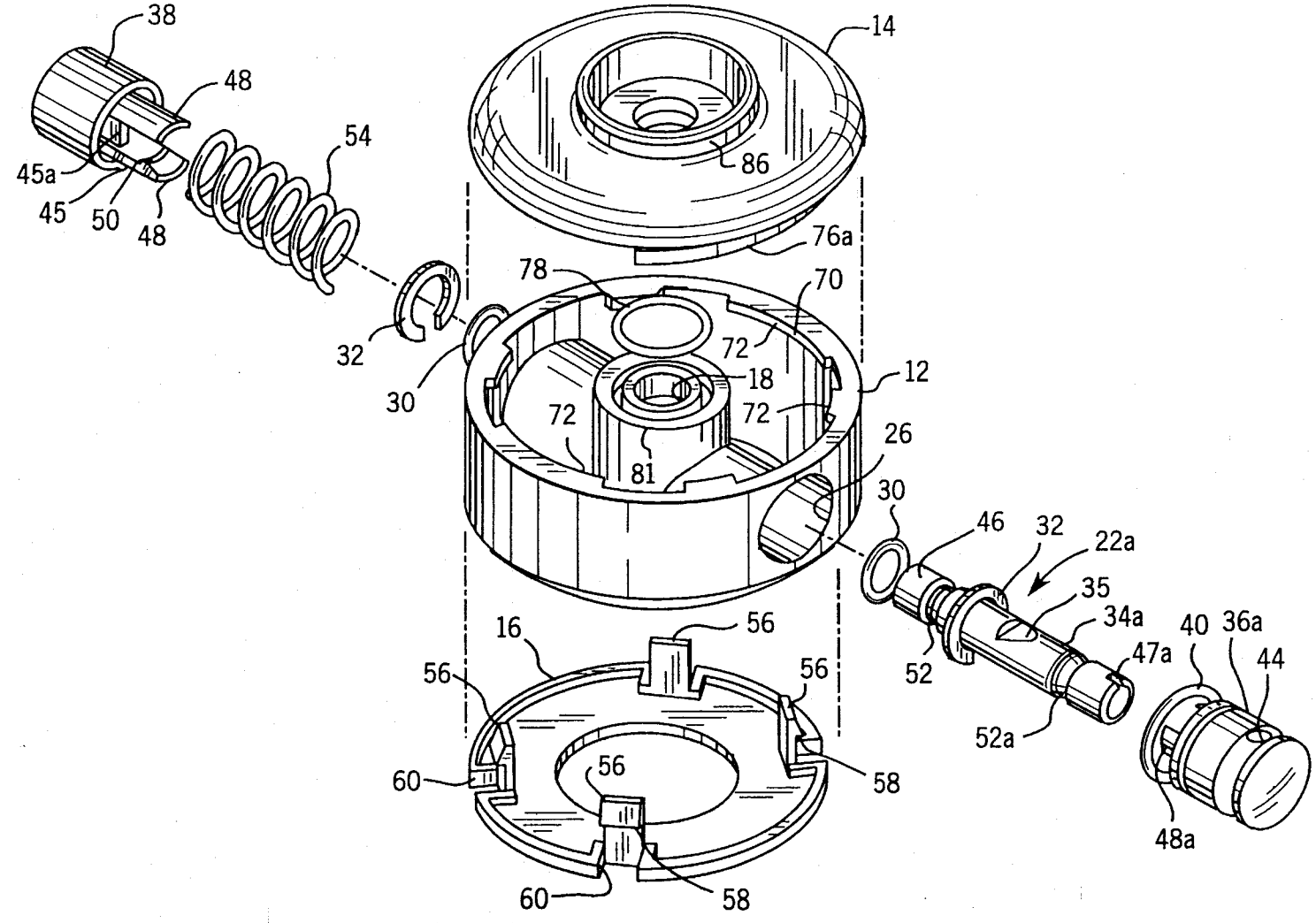
FIG. 6 is a view similar to FIG. 5 turned 180°.

In the alternate embodiment of the spigot assembly **22*a*, as shown in FIGS. 5 and 6, a two piece spigot 22*a* is shown which includes a shaft 34*a* and a cap 36*a*. The shaft 34*a* includes groove 52*a* at the outer end which matingly engages a pair of notches 50*a* in flanges 48*a*. A tab of the type shown in cap 38 is positioned to engage a slot 47*a* in the end of shaft 34*a* to prevent rotation of the cap 36*a* with respect to the shaft 34*a***.

Thus, it should be apparent that there has been provided in accordance with the present invention a drinking fountain attachment that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A tamper proof drinking fountain attachment for a water faucet, said attachment comprising a cylindrical base member having a centrally located water passage, a spigot assembly mounted in said base member for movement in a transverse relation to said water passage, a cover mounted on the top of said base member, means for permanently securing said cover to said base member, a cap mounted on the bottom of said base member, and means for permanently securing said cap to said base member wherein said fountain attachment includes a shaft having an angularly offset bore on one end and a spring mounted on the other end of said shaft for biasing said assembly to a closed position.

2. The attachment according to claim 1 wherein said shaft includes a notch intermediate the ends thereof for connecting the water passage to the offset bore.

3. The fountain attachment according to claim 1 including means for limiting the rotation of the spigot assembly to 60°.

4. The fountain attachment according to claim 3 wherein said base is free to rotate with respect to the cover.

5. A tamper proof drinking fountain attachment for a water faucet, said attachment comprising a cylindrical base member having a centrally located water passage, a spigot assembly mounted in said base member for movement in a transverse relation to said water passage, a cover mounted on the top of said base member, means for permanently securing said cover to said base member, a cap mounted on the bottom of said base member, and means for permanently securing said cap to said base member wherein said cover securing means comprises a pair of arcuate flanges in said base member and a number of arcuate flanges mounted on said cover, each of said flanges on said cover and base member including a notch for interengaging said flanges.

6. A tamper proof drinking fountain attachment for a water faucet, said fountain attachment comprising a cylindrical base member having a centrally located water passage, a spigot assembly mounted in said base member for movement in a transverse relation to said water passage, a cover mounted on the top of said base member, means for permanently securing said cover to said base member, a cap mounted on the bottom of said base member, and means for permanently securing said cap to said base member wherein said cap securing means comprises a number of blocks provided around the inner periphery of said base member and a tab on said cap corresponding to each of said blocks, each of said tabs including a flange for engaging said blocks and a slot in the periphery of said cap corresponding to each of said blocks for interengaging said blocks to prevent rotation of said cap.

7. A tamper proof drinking fountain attachment adapted to be mounted on a water faucet, the fountain attachment comprising a base member having a flow path aligned with the faucet and a passage transverse to the flow path, a spigot assembly mounted in the passage for movement between open and closed positions with respect to the flow path, a cover permanently mounted on the top of the base member for connecting the base member to the faucet and a cap permanently mounted on the bottom of the base member wherein said spigot assembly includes a shaft having an offset bore on one end for directing water angularly upwardly from the spigot assembly and means for biasing said shaft to a closed position in the base member.

8. The fountain attachment according to claim 7 wherein said cover includes a number of arcuate flanges spaced around the water passage, each flange including an outwardly directed catch and said base member including means for engaging said catches to prevent removal of the cover from the base member.

9. The fountain attachment according to claim 8 including a number of slots equally spaced around the perimeter of the cap and said base member includes a number of blocks positioned to engage said slots to prevent rotation of the cap with respect to the base member and means for securing said cap to said blocks.

10. A tamper proof fountain attachment adapted to be mounted on a water faucet, the fountain attachment comprising a base member having a flow path aligned with the faucet and a passage transverse to the flow path, a spigot assembly mounted in the passage for movement between open and closed positions with respect to the flow path, a cover permanently mounted on the top of the base member for connecting the base member to the faucet and a cap permanently mounted on the bottom of the base member wherein said spigot assembly includes a shaft having a notch on one end and a spigot mounted on said one end of said shaft, said shaft including a notch connecting said flow path to said spigot when the shaft is in the open position.

* * * * *